US006216417B1

(12) United States Patent
Morin et al.

(10) Patent No.: US 6,216,417 B1
(45) **Date of Patent: *Apr. 17, 2001**

(54) GLAZED ELEMENT HAVING A HIGH INSULATING POWER PROVIDED WITH A PLASTIC PROFILE

(75) Inventors: Claude M. Morin, Puteaux; Yves M. Demars, Clermont, both of (FR)

(73) Assignee: Saint-Gobain Vitrage, Courbevoie (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/058,954

(22) Filed: Apr. 13, 1998

(30) Foreign Application Priority Data

Jul. 7, 1997 (FR) ..... 97 08585

(51) Int. Cl.[7] ..... E06B 3/24; E06B 3/66

(52) U.S. Cl. ..... 52/786.1; 52/786.13; 52/788.1; 52/800.14; 52/208; 428/34

(58) Field of Search ..... 52/786.1, 786.13, 52/788.1, 800.13, 800.14, 208, 204.593, 235; 428/34

(56) References Cited

U.S. PATENT DOCUMENTS

| | | | | |
|---|---|---|---|---|
| 2,145,930 | * | 2/1939 | Herron | 52/800.14 X |
| 2,848,761 | * | 8/1958 | Hahn | 52/208 |
| 3,990,201 | * | 11/1976 | Falbel | 52/786.13 X |
| 4,089,143 | * | 5/1978 | La Pietra | 52/172 |
| 4,259,135 | * | 3/1981 | Kulla | 52/208 X |
| 4,336,413 | * | 6/1982 | Tourneux | 52/173.3 X |
| 4,683,154 | * | 7/1987 | Benson et al. | 52/786.1 X |
| 4,786,344 | * | 11/1988 | Beuther | 428/34 X |
| 4,822,649 | * | 4/1989 | Canaud et al. | 428/34 |
| 4,941,302 | * | 7/1990 | Barry | 52/786.13 X |
| 5,009,218 | * | 4/1991 | Bachli | 52/786.13 X |
| 5,027,569 | * | 7/1991 | Keys | 52/208 |
| 5,061,531 | * | 10/1991 | Catalano | 428/34 |
| 5,635,281 | * | 6/1997 | Agrawal | 428/34 X |
| 5,643,644 | * | 7/1997 | Demars | 52/786.1 X |
| 5,902,652 | * | 5/1999 | Collins et al. | 52/786.13 X |

FOREIGN PATENT DOCUMENTS

| | | | | |
|---|---|---|---|---|
| 3205294 | * | 8/1983 | (DE) | 52/786.1 |
| 2449189 | * | 9/1980 | (FR) | 52/786.13 |
| 2485076 | * | 12/1981 | (FR) | 52/786.1 |

OTHER PUBLICATIONS

Incropera & DeWitt, "Fundamentals of Heat and Mass Transfer, Third Edition", John Wiley & Sons, 3 sheets (see p. 47) 1990.*

* cited by examiner

*Primary Examiner*—Laura A. Callo
(74) *Attorney, Agent, or Firm*—Oblon, Spivak, McClelland, Maier & Neustadt, P.C.

(57) ABSTRACT

A glazed element having a high insulating power provided with a plastic profile, especially intended to be fastened to a bearing structure. The glazed element having a high insulating power includes at least two glass sheets between which a vacuum has been created, these being separated from each other by mounts distributed over the entire surface and being joined together around their periphery by an inorganic seal. At least part of the external surface of at least one of the inorganic seal and the at least two glass sheets covered by at least one plastic profile.

33 Claims, 3 Drawing Sheets

GLAZED ELEMENT HAVING A HIGH INSULATING POWER PROVIDED WITH A PLASTIC PROFILE

BACKGROUND OF THE INVENTION

1. Field of the Invention

The invention relates to a glazed element having a high insulating power provided with a plastic profile, especially intended to be fastened to a bearing structure.

It relates more particularly to the fastening of a glazed element having a high insulating power to a bearing structure by means of a technique consisting of fastening the glazed elements via its perimeter using a peripheral plastic frame.

2. Discussion of the Background

The description will be given with reference to the process for depositing a peripheral plastic frame using the techniques of deposition by injection molding, but the invention is not limited to this type of deposition.

In general, the glazed elements thus fastened are monolithic glazing assemblies or laminated glazing assemblies. In fact, such glazing assemblies, because of their structure and their mechanical behavior, may easily be provided with profiles around their periphery. The usual techniques of depositing a plastic profile on monolithic or laminated glazing assemblies by injection molding have been extensively described in many documents. These techniques form the subject of a great deal of research and of many improvements. At the present time, they are well controlled and widely used. However, these types of glazing assemblies do not meet the criteria of acoustic and thermal comfort which are desired in recent constructions.

In order to achieve thermal and/or acoustic insulation, it is usual to produce insulating glazing assemblies consisting of two substrates separated from each other by a relatively large air cavity, the sealing of which is provided in a known manner by a peripheral seal, and are supported by a frame which will be called hereinafter the supporting frame.

Each of the substrates may be a single plate of glass or may have a laminated structure. However, it should be noted that the usual techniques for depositing a peripheral plastic frame cause certain problems. This is because such insulating glazing assemblies have not been designed to withstand high peripheral pressures, because of the nature of the peripheral seals. The application of high pressures such as, for example, those necessary in the thermoplastic injection molding technique, would cause the peripheral seal to be crushed and, as a consequence, would therefore cause peripheral deformation of the glass sheets making up the insulating glazing panel. This deformation embrittling the insulating glazing panel and possibly even causing it to shatter.

Techniques for depositing a peripheral frame on insulating glazing assemblies are known. European patent EP-B-236,211 describes a glazing assembly consisting of two glass sheets separated by a dehydrated air cavity. The peripheral seal is obtained by in situ reactive injection molding under high pressure. A device which includes traction means has been proposed for producing this glazing assembly. These means pressing each glass sheet of the glazing assembly against a wall of the mold during the molding operation. In this way, the peripheral seal is prevented from being crushed.

It is, therefore, necessary to adapt the usual deposition techniques when these are applied to insulating glazing assemblies, thereby, considerably, increasing the cost of the glazing assembly.

Moreover, the usual insulating glazing assemblies provide a level of thermal insulation which is deemed to be unsatisfactory for some applications. In order to remedy this, it is known to produce glazing assemblies which comprise three sheets of glass and in which one of the air cavities can be replaced by a cavity filled with a gas such as krypton. These glazing assemblies have markedly improved insulation properties, but their structure and mechanical behavior are such that it is not easy for them to be used, in particular, in arrangements of the structural glazing type.

The aim of the invention is to produce an insulating glazing assembly provided with a peripheral plastic frame which obviates the various drawbacks mentioned above.

SUMMARY OF THE INVENTION

The subject of the invention is thus a glazed element having a high insulating power, composed of at least two glass sheets between which a vacuum has been created. The glass sheets being separated from each other by mounts distributed over the entire surface and being joined together around their periphery by an inorganic seal. The glazed element being such that at least part of its external surface is covered by at least one plastic profile and, preferably, at least part of its periphery is likewise covered on at least one of its faces.

Patent Application EP-A-0,645,516 describes an insulating glazing assembly composed of two glass sheets separated from each other by a small gap in which a vacuum has been created. The glass sheets are separated from each other by mounts distributed over the entire surface and are joined together around their peripheries by an inorganic seal. The structure of such a glazing assembly has the advantage of giving it rigidity and strength, which are equivalent to those of a monolithic glazing assembly having a thickness equal to the sum of the thicknesses of the glass sheets, i.e. the glass sheets behave as a single sheet whose thickness is the sum of the two. Advantageously, this type of glazing assembly has a small thickness for markedly improved thermal insulation properties. In this way, the glazed element having a high insulating power, because of its mechanical behavior, does not require supporting frames, unlike the usual insulating glazing assemblies. Thus, the fastening of such glazed elements may be carried out by means of plastic profiles positioned around the periphery on at least one face of the glazed element, without any risk of damaging the glazed element, in particular the peripheral seal.

According to variants of the invention, the plastic profile also covers the thin edge and/or both faces of the glazed element. In this way, the contact area between the glazed element and the plastic profile is greater and the glazed element can be held in place mechanically and/or by adhesive bonding.

According to another embodiment, the plastic profile covers the entire periphery of the element. Advantageously, this arrangement of the plastic profile makes it much easier to perform the on-site handling, transporting and fitting operations. This is because this arrangement provides better protection of the glazing assembly and more particularly of its edges, and, in particular, allows the possibility of stacking the glazing assemblies one on top of the other without having to insert spacers, the glazed surfaces not being in contact with one another because of the extra thickness of the profiles.

To this protective aspect may be added an aesthetic aspect. The external part of the plastic profile masking its own internal part and the peripheral seal of the glazed element and possibly being either colored or painted in order to match it to the bearing structure to which the glazed element is intended to be fastened.

According to one variant of the invention, the plastic profile is an overmolded profile obtained by thermoplastic injection molding or by reactive injection molding. The technique of injection overmolding a surround on the perimeter of a monolithic or laminated glazing assembly has been described in many documents, for instance in Patents EP-B-127,546 and EP-B-145,443. The inventors have demonstrated that the application of such injection overmolding techniques on glazed elements according to the invention makes it possible to produce plastic profiles without any risk of damaging or shattering the glazed element. Since the mechanical strength of these glazed elements is equivalent to that of monolithic elements, it is possible to apply high pressures to the edges of the glazed element, unlike the usual insulating glazing assemblies. Advantageously, this injection overmolding technique is employed when the plastic profile covers at least one face and the thin edge of the glazed element.

According to another variant of the invention, the plastic profile is an extruded profile. Extruded profile is understood to mean any type of profile prefabricated by extrusion, which can be adhesively bonded to the glazed element or extruded directly onto the glazed element. The technique of depositing an elastomeric frame on a monolithic or laminated glazing assembly by extrusion has been described in many documents, for instance in European Patents EP-B-121,481 and EP-B-524,092. The inventors have demonstrated that the use of such conventional techniques of deposition by extrusion cause no problem with the glazed element according to the invention. Advantageously, this technique of deposition by extrusion is used when the plastic profile covers only one face of the glazed element.

In all cases, to ensure good adhesion of the plastic profile to the glass, an adhesion promoter, deposited around the periphery of the glazed element, is used before depositing the plastic.

According to an advantageous embodiment of the invention, the plastic profile has, substantially in the plane of the glazed element, a projecting part constituting one element of a fastening system. In this way, the glazed element provided with such a profile can be easily fastened to a bearing structure, for example by adhesive bonding of the said projecting part to the bearing structure, by nailing through the said projecting part or else by any other means known to those skilled in the art.

Advantageously, the projecting part of the plastic profile may constitute a means for centering the glazed element with respect to the bearing structure, for example when the latter consists of a system of cavities into which the glazed element is to be set.

According to one particular embodiment of the invention, the projecting part of the plastic profile has protruding regions, such as lugs, rims and stops, which participate in the installing, fitting and/or fastening of the glazed element.

Preferably, the plastic profile has a shape suitable for the type of fastening envisaged for a type of application in question, such as, for example, a sealing lip near the upper surface of the glazed element and a fastening lug near the projecting part of the profile for an arrangement of the overlapping scales type for the construction of roofing. In this particular embodiment, the fastening lug allows the glazed elements to be positioned uniformly on the battens of the roof structure and the sealing lip then comes into contact with the upper glazed element which partially overlaps the glazed element so as to thus seal the combination at this overlap.

According to a preferred embodiment of the invention, at least one insert is embedded in the plastic profile. The presence of such inserts, for example made of metal, allow the glazed element to be fastened to a bearing structure, it being possible for this fastening, for example, to be of the snap-fastening type or of the bolted type, or allow the glazed elements to be fastened to each other.

According to an advantageous variant of the invention, the glass sheets of the glazed element undergo a tempering treatment. This tempering operation enables the strength of the glass sheets, when creating the vacuum, to be increased, as well as the overall strength of the glazed element in its various applications.

Moreover, at least one of the glass sheets advantageously has a low-emissivity coating on its internal face, i.e., on the face in contact with the mounts. This coating may contribute to the thermal insulation function.

The subject of the invention is also the incorporation of the above-defined glazed element into specific uses.

A first use relates to the construction of roofing, the glazed elements acting as covering tiles or panels.

According to a preferred embodiment of the invention, the roofing is constructed by fastening the said glazed elements by nailing, bolting or cleating through the projecting part of the plastic profiles.

A second use relates to the construction of large-area curtain walling for buildings. This type of application makes it possible to produce curtain walling for buildings which consists entirely of glazed elements, some of them being transparent and acting as glazing for vision while others are opaque, providing in general a lightening function. Such curtain walling has a minimum of surface discontinuities seen from the outside.

A third use relates to the construction of doors or walls of environmental chambers. This type of application has the advantage of providing, for a small wall thickness, very high thermal insulation for this kind of use, which thermal insulation cannot be achieved with the usual insulating glazing assemblies having an overall thickness meeting the size and visibility criteria.

BRIEF DESCRIPTION OF THE DRAWINGS

The advantageous characteristics of the invention will be more apparent in the detailed description below of non-limiting exemplary embodiments illustrated by the figures, wherein.

DESCRIPTION OF THE PREFERRED EMBODIMENTS

Figure 1:
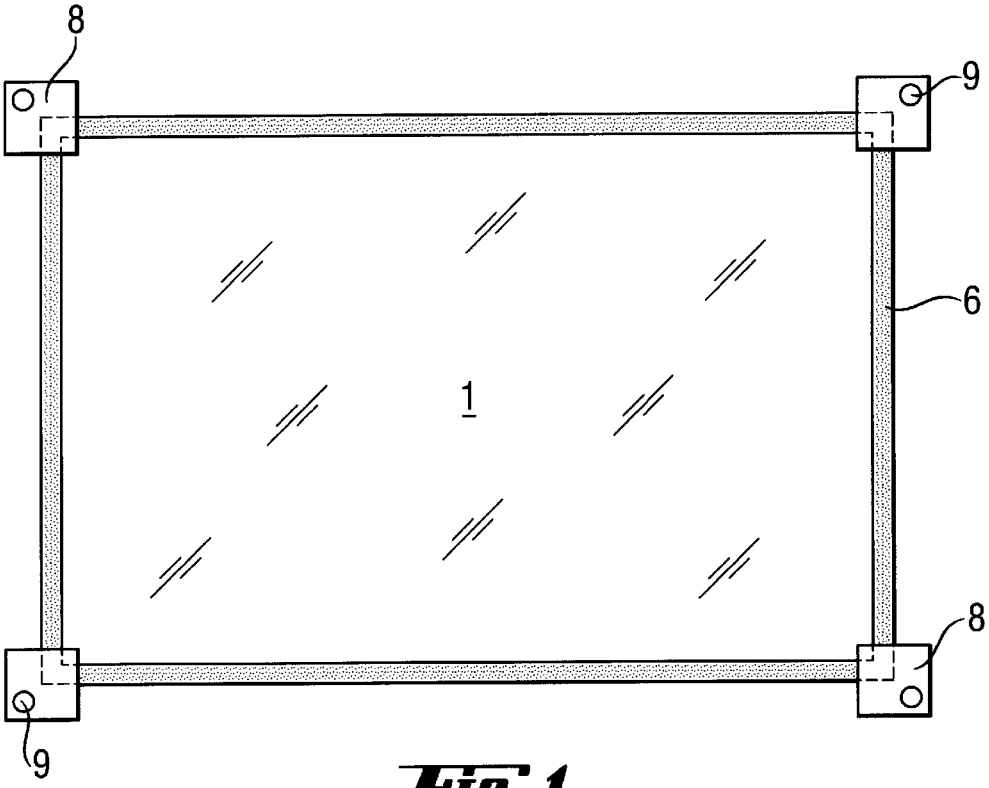
FIG. 1 is a top view of a glazed element having a high insulating power, provided at its four comers with a plastic profile.

It should be pointed out that the proportions between the various elements depicted are not strictly respected in these figures so as to make it easier to examine them. Referring now to the drawings, wherein like reference numerals designate identical or corresponding parts throughout the several views, and more particularly to FIG. 1 thereof, where a glazed element 1 has been created. The glazed element 1 having a high insulating power consists of two glass sheets 2 and 3 between which a vacuum 4 has been created, these being separated from each other by mounts 5 distributed over the entire surface and being joined together around their periphery by an inorganic seal 6.

According to this representation, the glass sheet 2 is coated on its internal face with a low-emissivity coating 7. This coating is, for example, of the type described in French Patent No. 2,701,474 filed in the name of Saint-Gobain Vitrage International. The mounts 5 have a thickness of 0.2 millimeters and a diameter of 0.4 millimeters. They are distributed over the entire surface of the glass sheets and are separated from each other by 30 millimeters.

The mounts 5 are deposited on one of the glass sheets 2 and 3 after the latter have been coated with a low-emissivity coating 7, for example by pyrolytic deposition, and then tempered. After a bead of glass flit has been deposited around the periphery of the second glass sheet, the two glass sheets 2 and 3 are assembled and then the whole assembly is subjected to a heat treatment in order to weld the two glass sheets 2 and 3 together, the seal 6 then sealing the whole assembly. A vacuum is then created between the two glass sheets 2 and 3 by any means known to those skilled in the art, such as, for example, the process described in the French patent application filed in the name of Saint-Gobain Vitrage under No. 96/09632. The glazed element is then ready to be equipped with a plastic profile.

FIG. 1 depicts the glazed element 1, the four corners of which are covered by a plastic profile 8. The plastic profiles 8 allow the whole assembly to be mechanically fastened to a bearing structure, by means of the fastening points 9. It is also possible to place the plastic profiles 8 elsewhere, i.e., other than at the corners.

Figure 2:
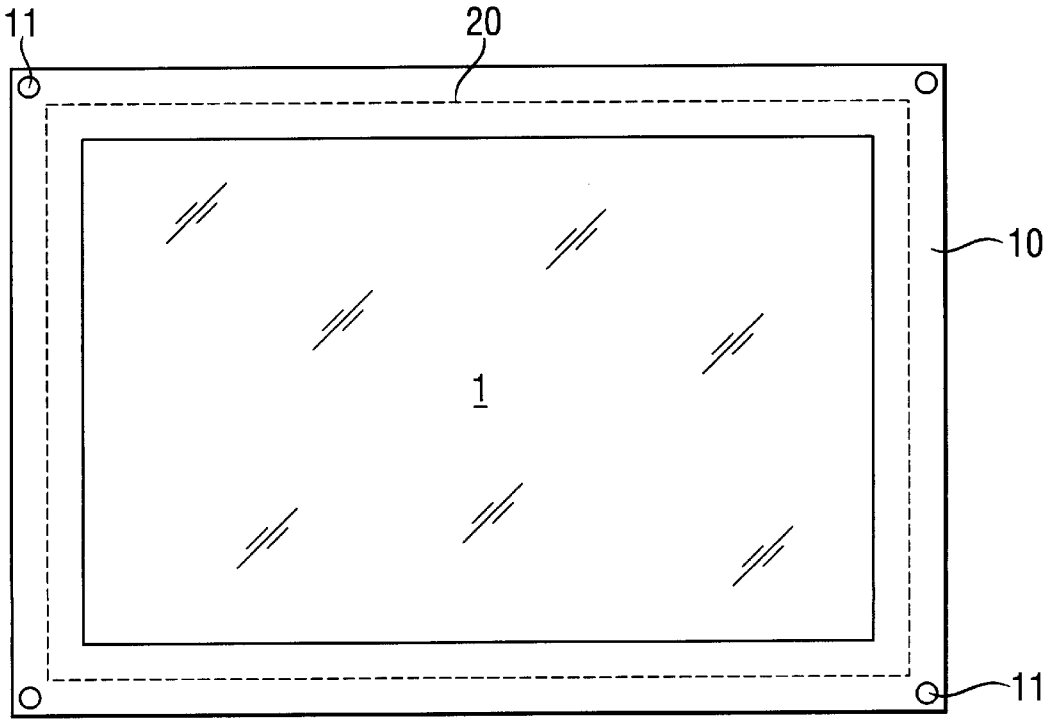
FIG. 2 is a top view of a glazed element having a high insulating power, provided over its entire periphery with a plastic profile.

FIG. 2 depicts the glazed element 1 whose edge is illustrated by a dotted line 20 and whose entire periphery is covered by a plastic profile 10.

Likewise, this plastic profile 10 allows the whole assembly to be mechanically fastened to a bearing structure, by means of the fastening points 11. Fastening points other than those at the corners are also possible. The number of fastening points will be determined depending on the size of the element 1, on the type of application envisaged and on the desired aesthetic appearance.

The plastic profiles 8 and 10 will preferably be obtained by thermoplastic injection molding or by reactive injection molding or by extrusion.

The techniques of deposition by injection molding have been described in many documents. In general, they consist in placing around the edge of the element a mold formed by two mold halves, which defines the molding cavity After closing the mold, the molding cavity is filled with a plastic. When the plastic present inside the mold forms a profile which no longer deforms, the mold is opened and the element thus framed is removed from the mold.

In the technique of deposition by reactive injection molding, the plastic is a reactive mixture which expands in the cavity and forms a porous molded body with a shell which provides sealing.

In the technique of deposition by thermoplastic injection molding, the cavity of the mold is filled with a molten thermoplastic under a relatively high pressure.

The technique of deposition by extrusion has also been described in many documents such as, for example, in European Patent EP-B-524,092. In general, it consists in using a robot which moves an extrusion nozzle around the periphery of the element so as to deposit thereat a plastic profile in a defined path which may or may not be continuous, the extrusion nozzle being supplied with plastic from an extruder via a pressure hose.

The technique of deposition by extrusion will be preferred when the plastic profile covers only one face, this technique being more suitable for surface deposition. In addition, this technique does not require the production of molds tailored to each type of element, Whatever the technique used, it is advantageous, before depositing the plastic, to use an adhesion promoter deposited around the periphery of the glazed element in order to ensure good adhesion of the plastic profile to the glass.

The choice of the composition of the primer, used as the adhesion promoter, depends on the nature of the profile. This composition is, for example, of the type described in European Patents EP-0,574,315 and EP-0,603,072, i.e., based on at least one silane and on a composition capable of forming a coating having free hydroxyl groups. This type of composition gives good results for thermoplastic profiles such as those, for example, made of polyurethane.

Figure 3:
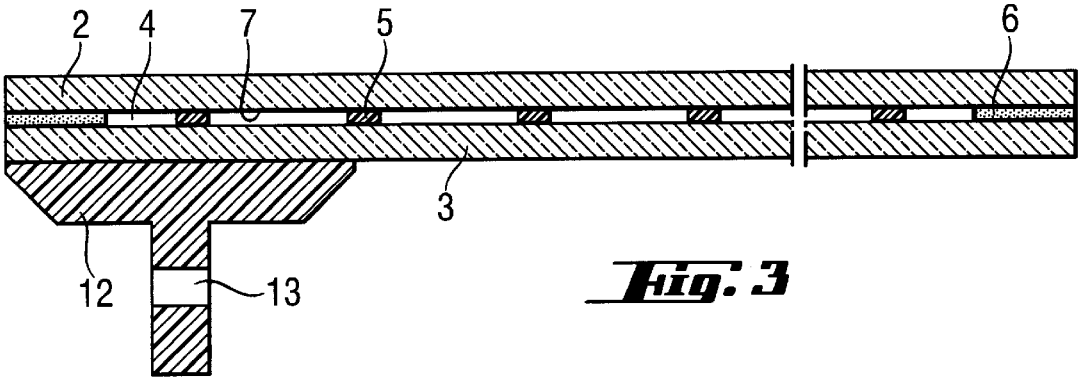
FIG. 3 a cross-section of a glazed element according to the invention.

FIG. 3 depicts a first embodiment of the glazed element according to the invention. In this representation, the glazed element 1 is covered by a plastic profile 12 on only one of its faces. The plastic profile 12 being positioned on the periphery of the glass sheet 3. Advantageously, in its thickness, this plastic profile 12 has a hole 13 which allows insertion of a fastening element such as, for example, a nut-and-bolt system. This fastening element allowing the glazed element to be fastened to a bearing structure by means of the plastic profile 12.

Figure 4:
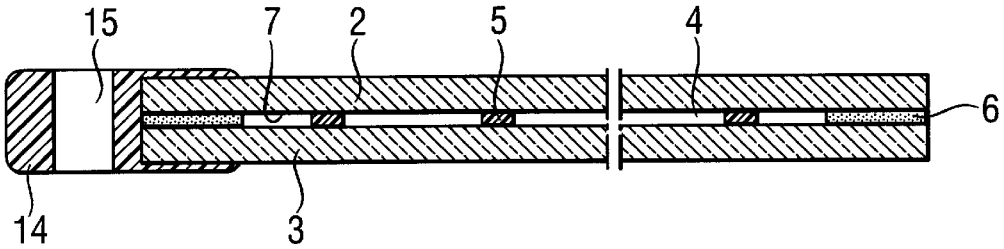
FIG. 4 is a cross-section of a second embodiment of a glazed element according to the invention.

FIG. 4 depicts a second embodiment of the glazed element according to the invention. In this representation, the glazed element 1 is covered by a plastic profile 14 on both its faces and on its thin edge, i.e., the plastic profile 14 is positioned over the entire edge of the glazed element 1. Advantageously, this plastic profile 14 has a material allowance in the region of the thin edge of the glazed element, this part of the plastic profile being drilled forming a hole 15 so that a fastening element such as, for example, a nut-and-bolt system, can be inserted thereinto for fastening to a bearing structure.

Figure 5:
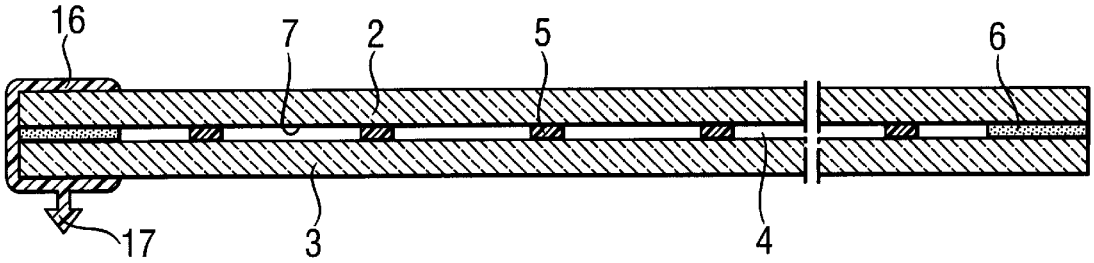
FIG. 5 is a cross-section of a third embodiment of a glazed element according to the invention.

FIG. 5 depicts a third embodiment of the glazed element according to the invention. In this representation, the glazed element 1 is covered by a plastic profile 16 over the entire edge of the glazed element 1. Advantageously, this plastic profile 16 has a female member 17 of a snap-fastening system, the corresponding male member forming an integral part of the bearing structure then engaging in this member 17. The member 17 may also be the male member of a snap-fastening system, which engages in the corresponding female member forming an integral part of the bearing structure.

Figure 6:
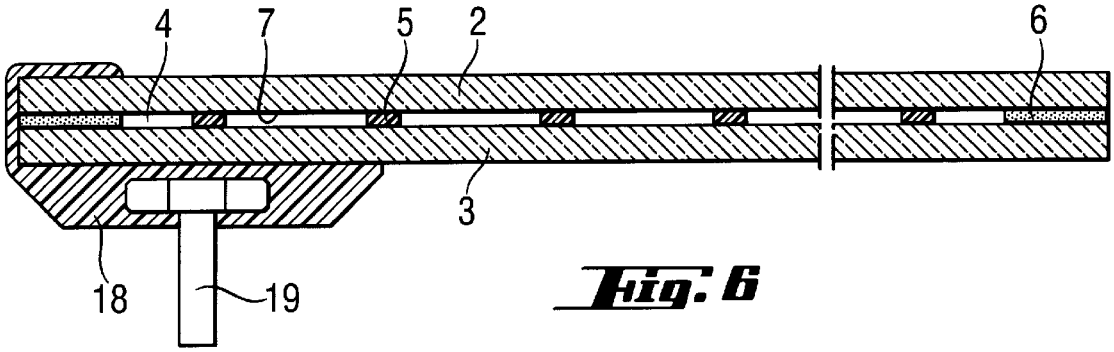
FIG. 6 is a cross-section of a fourth embodiment of a glazed element according to the invention.

FIG. 6 depicts a fourth embodiment of the glazed element according to the invention, According to this representation, the glazed element 1 is covered by a plastic profile 18 over the entire edge of the glazed element 1. The plastic profile 18 is provided with a metal insert 19, part of which is embedded in the plastic profile 18. The metal insert 19 engaging with a fastening means so as to allow the glazed element 1 to be fastened to a bearing structure. For example, the metal insert 19 may be a bolt, only the head of which is embedded in the plastic profile 18.

Figure 7:
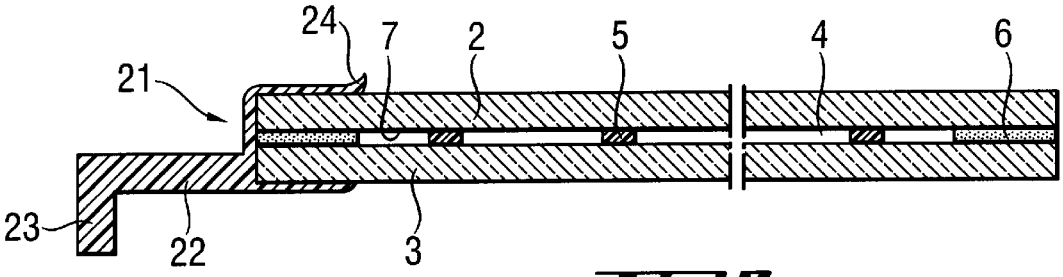
FIG. 7 is a cross-section of a fifth embodiment of a glazed element according to the invention.

FIG. 7 depicts a fifth embodiment of the glazed element according to the invention. In this representation, the glazed element 1 is covered by a plastic profile 21 over its entire edge. Advantageously, this plastic profile 21 has, substantially in the plane of the glazed element 1, a projecting part 22. The end of this projecting part 22 has an L-shaped appendage 23, which we will call a fastening lug, and, near the covering of the edge of the glass sheet 2, the plastic profile 21 has a lip 24 which we will call the sealing lip. This type of plastic profile 21 is particularly suitable for the construction of tiles mounted in the form of overlapping scales, the fastening lug butting against a batten of a roof structure and the plastic profile 21 then being nailed to the batten. The lip 24 makes it possible to seal between two glazed elements fastened in this way in the region of their horizontal overlap.

The invention is not limited to these types of embodiment and must be interpreted in a non-limiting manner, encompassing all types of glazed element having a high insulating power provided with a plastic profile over at least part of its periphery and on at least one of its faces.

Obviously, numerous modifications and variations of the present invention are possible in light of the above teachings. It is therefore to be understood that within the scope of the appended claims, the invention may be practiced otherwise than as specifically described herein.

What is claimed is:

1. A glazed element, comprising:

at least two glass sheets;

a plurality of mounts distributed over an internal face of each of said at least two glass sheets so as to separate each of said at least two glass sheets;

an inorganic seal disposed between peripheries of said at least two glass sheets and configured to seal a vacuum formed between said at least two glass sheets; and at least one plastic profile formed by injection molding directly onto at least part of an external surface of at least one of said inorganic seal and one or both of said at least two glass sheets, said at least one plastic profile being configured to be mounted to a bearing structure.

2. A glazed element according to claim 1, wherein said at least one plastic profile covers part of at least one external face of said at least two glass sheets.

3. A glazed element according to claim 2, wherein said at least one plastic profile covers at least part of edge peripheries of said inorganic seat and said at least two glass sheets.

4. A glazed element according to claim 3, wherein said at least one plastic profile covers part of two external faces of said at least two glass sheets.

5. A glazed element according to claim 2, wherein said at least one plastic profile covers part of two external faces of said at least two glass sheets.

6. A glazed element according to claim 2, wherein said at least one plastic profile has, substantially in a plane of said at least two glass sheets, a projecting part constituting one element of a fastening system.

7. A glazed element according to claim 1, wherein said at least one plastic profile covers at least part of edge peripheries of said inorganic seal and said at least two glass sheets.

8. A glazed element according to claim 7, wherein said at least one plastic profile covers part of two external faces of said at least two glass sheets.

9. A glazed element according to claim 7, wherein said at least one plastic profile has, substantially in a plane of said at least two glass sheets, a projecting part constituting one element of a fastening system.

10. A glazed element according to claim 1, wherein said at least one plastic profile is an overmolded profile obtained by thermoplastic injection molding or by reactive injection molding.

11. A glazed element according to claim 1, wherein said at least one plastic profile is an extruded overmolded profile.

12. A glazed element according to claim 1, wherein said at least one plastic profile has, substantially in a plane of said at least two glass sheets, a projecting part constituting one element of a fastening system.

13. A glazed element according to claim 12, wherein said projecting part of said at least one plastic profile has at least one protruding region which participates in the installing, fitting or fastening of the glazed element.

14. A glazed element according to claim 1, further comprising at least one insert with which a fastening means engages is embedded in said at least one plastic profile.

15. A glazed element according to claim 1, wherein said at least two glass sheets are made of tempered glass.

16. A glazed element according to claim 1, wherein at least one of said at least two glass sheets has a low-emissivity coating on its internal face which is in contact with said mounts.

17. A glazed element according to claim 1, wherein said at least one plastic profile includes a male member configured to snap-fasten with a prefabricated female mounting device.

18. A glazed element according to claim 1, wherein said at least one plastic profile includes at least one aperture configured to engage with a prefabricated mounting device.

19. A glazed element according to claim 18, wherein said at least one plastic profile comprises an extruded overmolded profile.

20. A glazed element according to claim 18, wherein said at least two glass sheets are made of tempered glass.

21. A glazed element according to claim 18, wherein said at least one of said at least two glass sheets includes a low-emissivity coating on its internal face which is in contact with said mounts.

22. A glazed element according to claim 18, wherein said at least one plastic profile is projected in a longitudinal direction of said at least two glass sheets.

23. A glazed element according to claim 18, wherein said at least one plastic profile comprises an overmolded profile obtained by thermoplastic injection molding or by reactive injection molding.

24. A glazed element according to claim 18, wherein said at least one plastic profile includes a projection protruding perpendicular to said at least two glass sheets, in which said at least one aperture is located.

25. A glazed element according to claim 18, wherein said at least one aperture is configured to engage with a nut-and-bolt system.

26. A glazed element according to claim 18, wherein said glazed element is incorporated into a curtain wall structure for buildings.

27. A glazed element according to claim 18, wherein said glazed element is incorporated into doors and walls of environmental chambers.

28. A glazed element according to claim 1, wherein at least one plastic profile includes an L-shaped lug configured to fasten with a batten of a roof structure and a lip configured to seal between said glazed element and an overlapping element, said at least one plastic profile covering at least part of an external surface of at least one of said inorganic seal and said at least two glass sheets.

29. A glazed element according to claim 28, wherein said glazed element is incorporated into a roof structure.

30. A glazing roof structure, comprising:

at least two glass sheets;

a plurality of mounts distributed over an internal face of each of said at least two glass sheets so as to separate each of said at least two glass sheets;

an inorganic seal disposed between peripheries of said at least two glass sheets and configured to seal a vacuum formed between said at least two glass sheets; and at least one plastic profile formed by injection molding directly onto at least part of an external surface of at least one of said inorganic seal and one or both of said at least two glass sheets, said at least one plastic profile being configured to be mounted to a bearing structure.

31. A glazing roof structure according to claim 30, wherein the glazing roof structure is fastened to a roof structure by nailing, bolting or cleating through a projecting part of said at least one plastic profile.

32. A glazing curtain wall structure for buildings, comprising:

at least two glass sheets;

a plurality of mounts distributed over an internal face of each of said at least two glass sheets so as to separate each of said at least two glass sheets;

an inorganic seal configured to join peripheries of said at least two glass sheets and configured to seal a vacuum formed between said at least two glass sheets; and at least one plastic profile formed by injection molding directly onto at least part of an external surface of at least one of said inorganic seal and one or both of said at least two glass sheets, said at least one plastic profile being configured to be mounted to a bearing structure.

33. A glazing wall of environmental chambers, comprising:

at least two glass sheets;

a plurality of mounts distributed over an internal face of each of said at least two glass sheets so as to separate each of said at least two glass sheets;

an inorganic seal configured to join peripheries of said at least two glass sheets and configured to seal a vacuum formed between said at least two glass sheets; and at least one plastic profile formed by injection molding onto at least part of an external surface of at least one of said inorganic seal and one or both of said at least two glass sheets, said at least one plastic profile being configured to be mounted to a bearing structure.

* * * * *